US005533435A

United States Patent [19]

Kita

[11] Patent Number: 5,533,435

[45] Date of Patent: Jul. 9, 1996

[54] FLUID CYLINDER ASSEMBLY

[75] Inventor: Kazushi Kita, Yawara-mura, Japan

[73] Assignee: SMC Corporation, Tokyo, Japan

[21] Appl. No.: 508,527

[22] Filed: Jul. 28, 1995

[30] Foreign Application Priority Data

Aug. 22, 1994 [JP] Japan ..... 6-219508

[51] Int. Cl.[6] ..... F15B 11/00; F01B 7/00

[52] U.S. Cl. ..... 91/519; 92/152

[58] Field of Search ..... 92/113, 22, 27, 92/28, 152; 91/519, 170 R, 41, 43

[56] References Cited

U.S. PATENT DOCUMENTS

| | | | |
|---|---|---|---|
| 2,472,236 | 6/1949 | Thomas | 92/152 X |
| 3,502,001 | 3/1970 | Moore | 92/152 X |
| 4,930,402 | 6/1990 | Forchheim et al. | 91/170 R X |
| 5,361,680 | 11/1994 | Matsui | 91/519 |
| 5,435,228 | 7/1995 | Snitgen | 91/519 X |

OTHER PUBLICATIONS

English Abstract of JP 5–16411, Jun. 29, 1993, Akio Matsui.
English Abstract of JP 6–42507, Feb. 15, 1994, Akio Matsui.

*Primary Examiner*—Hoang Nguyen
*Attorney, Agent, or Firm*—Oblon, Spivak, McClelland, Maier & Neustadt

[57] ABSTRACT

A first cylinder of a smaller diameter and a second cylinder of a larger diameter are connected in a coaxially intercommunicating state. A first piston of a smaller diameter which is hermetically slidable within the first cylinder is mounted on a rod which is commonly passed through the two cylinders in such a way as to permit the first piston to move also in the second cylinder. Received in the second cylinder is a second piston which is hermetically slidable only in the second cylinder and which is adapted to be integrally coupled with the first piston during movements within the second cylinder.

6 Claims, 8 Drawing Sheets

FLUID CYLINDER ASSEMBLY

BACKGROUND OF THE INVENTION

Field of the Art

This invention relates to fluid cylinders, and more particularly to a fluid cylinder assembly of the sort which is capable of producing a greater driving force in a latter half of its driving stroke.

Prior Art

As for fluid cylinders with a larger driving force, there has been known in the art the so-called tandem type fluid cylinder having a plural number of fluid cylinder units connected in series in the axial direction and having a plural number of pistons mounted on a single rod in axially spaced relations with each other for reciprocating movements separately within the respective cylinder units.

The conventional tandem type fluid cylinder, with a series of fluid cylinder units in the axial direction as mentioned above, is capable of producing a larger driving force over the entire driving stroke range of the rod. However, since a plural number of pistons are reciprocated separately within the respective cylinder units which are connected end to end in the axial direction, it is usually the case that the overall stroke length of the rod is substantially same as the stroke length of each cylinder unit. Therefore, in terms of the effective stroke length, the existing tandem type fluid cylinders are often found too lengthy in the axial direction for installations in narrow limited spaces.

On the other hand, for larger driving forces, there have also been known in the art fluid cylinders of the sort which are arranged to produce a larger driving force in a latter half of each driving stroke, for example, as in the case of the fluid cylinders which are employed generally in spot welding. For instance, Japanese Laid-Open Patent Specifications H5-164111 and H6-42507 disclose fluid cylinders in which a booster piston is coupled with a rod in a latter half of the driving stroke of the rod.

However, a fluid cylinder of this type is substantially same as a couple of cylinder units which are connected in series in the axial direction, so that the overall length of the fluid cylinder assembly is increased to an extent corresponding to the stoke length of a booster piston, failing to meet the demand for fluid cylinders of compact form especially in length in the axial direction.

SUMMARY OF THE INVENTION

It is a primary object of the present invention to provide a fluid cylinder assembly which is capable of producing a greater driving force in a latter half of its driving stroke and yet compact in construction.

It is another object of the present invention to provide a fluid cylinder assembly employing a combination of smaller- and larger-diameter pistons which are arranged to be coupled with each other in a latter half of each driving stroke of a piston rod in such a way as to broaden the pressure receiving area of the piston as a whole for producing a boosted driving force in a secure manner.

It is another object of this invention to provide a fluid cylinder assembly employing a coupling mechanism which is capable of securely coupling and uncoupling the above-mentioned smaller- and larger-diameter pistons.

It is still another object of this invention to provide a fluid cylinder assembly employing a valve means to ensure smooth movements of the smaller- and larger-diameter pistons in coupling and uncoupling phases of operation.

In accordance with the present invention, the above-stated objectives are achieved by the provision of a fluid cylinder assembly which essentially includes: a first cylinder of a smaller diameter and a second cylinder of a larger diameter, connected with each other in a coaxially intercommunicating state through a joint member; a piston rod commonly passed through the first and second cylinders; a larger piston fitted in the second cylinder for sliding movements only in and along the second cylinder; a smaller piston mounted at one end of the piston rod for movements in and along the first and second cylinders over the entire stroke range of the piston rod, the smaller piston being adapted to move as a solitary body within the first cylinder in fluid-tight sliding contact therewith and to be coupled with the larger piston during movement within the second cylinder; a biasing means for urging the larger piston toward a return end position at the head end of the second cylinder; a coupling mechanism for coupling the smaller piston with the larger piston during movement within the second cylinder; and a valve means adapted to open a chamber on the head side of the second cylinder to the atmosphere when the larger piston is located at the return end position and to shield the chamber from the atmosphere when the larger piston is moved away from the return end position.

In a preferred form of the invention, the above-mentioned piston coupling mechanism includes: a coupling groove formed around the circumference of the smaller piston; a plural number of locking segments provided on the part of the larger piston and arranged in a ring-like form around the piston rod, the locking segments being radially displaceable into and out of engagement with the coupling groove; a spring means urging the respective locking segments toward the coupling groove; a cam means for displacing the respective locking segments radially into and out of engagement with the coupling groove, the cam means moving the locking segments into a released position away from the coupling groove when the larger piston is located at the return end position within the second cylinder and into a locking position in engagement with the coupling groove when the smaller piston comes into abutment against the larger piston in the course of a driving stroke of the piston rod.

In this instance, desirably the cam means is constituted by a number of cam pins which are partly retractably projected out of pin nesting holes on the larger piston. The cam pins are pushed into retracted positions in the pin nesting holes by the joint member when the larger piston is abutted against the joint member at the return end position in the second cylinder, forcing the respective locking segments to displace into the released position away from the coupling groove. The cam pins are allowed to project out of the pin nesting holes as soon as the larger piston is moved away from the joint member, permitting the respective locking segments to move into coupling positions in engagement with the coupling groove.

Preferably, for serving also as the afore-mentioned valve means, the cam pins are provided with O-rings to be disengageably brought into engagement with seal portions of the pin nesting holes. When the cam pins are pushed into retracted positions by abutment against the joint member at the return end of the larger piston, the respective O-rings are disengaged from the seal portions to open the afore-mentioned chamber to the atmosphere. As soon as the larger piston is moved away from the joint member, the cam pins are projected from the pin nesting holes, abutting the respective O-rings against the seal portions to shield the aforementioned chamber from the atmosphere.

In another preferred form of the invention, the piston coupling mechanism includes: a coupling groove formed around the circumference of the smaller piston; a plural number of balls retained in a ball holder on the larger piston and adapted to be brought into and out of engagement with the coupling groove; a sleeve-like ball presser slidably fitted on the outer periphery of the ball holder and axially displaceable between a locking position for holding the balls in the coupling groove and a releasing position for releasing the balls from the coupling groove, the ball presser being displaced toward the releasing position when the larger piston is abutted against the joint member at the return end position and displaced toward the locking position when the larger piston is moved away from the joint member; and a spring means for urging the ball presser toward the locking position.

In this case, preferably the above-mentioned valve means is provided on the joint member, including a valve chamber which communicates the chamber on the head side of the second cylinder with the atmosphere through an air passage and a valve member disposed in the valve chamber for opening and closing the air passage. The valve member is constantly urged by a spring to protrude partly into the chamber in the second cylinder, the valve member opening the air passage when pushed into the valve chamber by the larger piston and to close the air passage when released into the protruded position.

According to the fluid cylinder of the present invention with the above-described construction, the smaller piston is coupled with the larger piston in a latter half of each driving stroke of the piston rod, thereby broadening the pressure receiving area of the piston as a whole for boosting the driving force in the latter half of the driving stroke.

Besides, the smaller piston is arranged to move in and along both of the larger- and smaller-diameter cylinders and to be coupled with the larger piston during movement in the larger-diameter cylinder, so that, in securing a given stroke length of the rod, it becomes possible to minimize the axial length of the fluid cylinder assembly to a marked degree as compared with the conventional tandem type fluid cylinders in which a couple of pistons are put in reciprocating movements separately within the respective cylinders. Consequently, the fluid cylinder construction according to the invention can be provided in a very compact form.

The above and other objects, features and advantages of the invention will become apparent from the following description, taken in conjunction with the accompanying drawings which show by way of example preferred embodiments of the invention.

DESCRIPTION OF PREFERRED EMBODIMENTS

Figure 1:
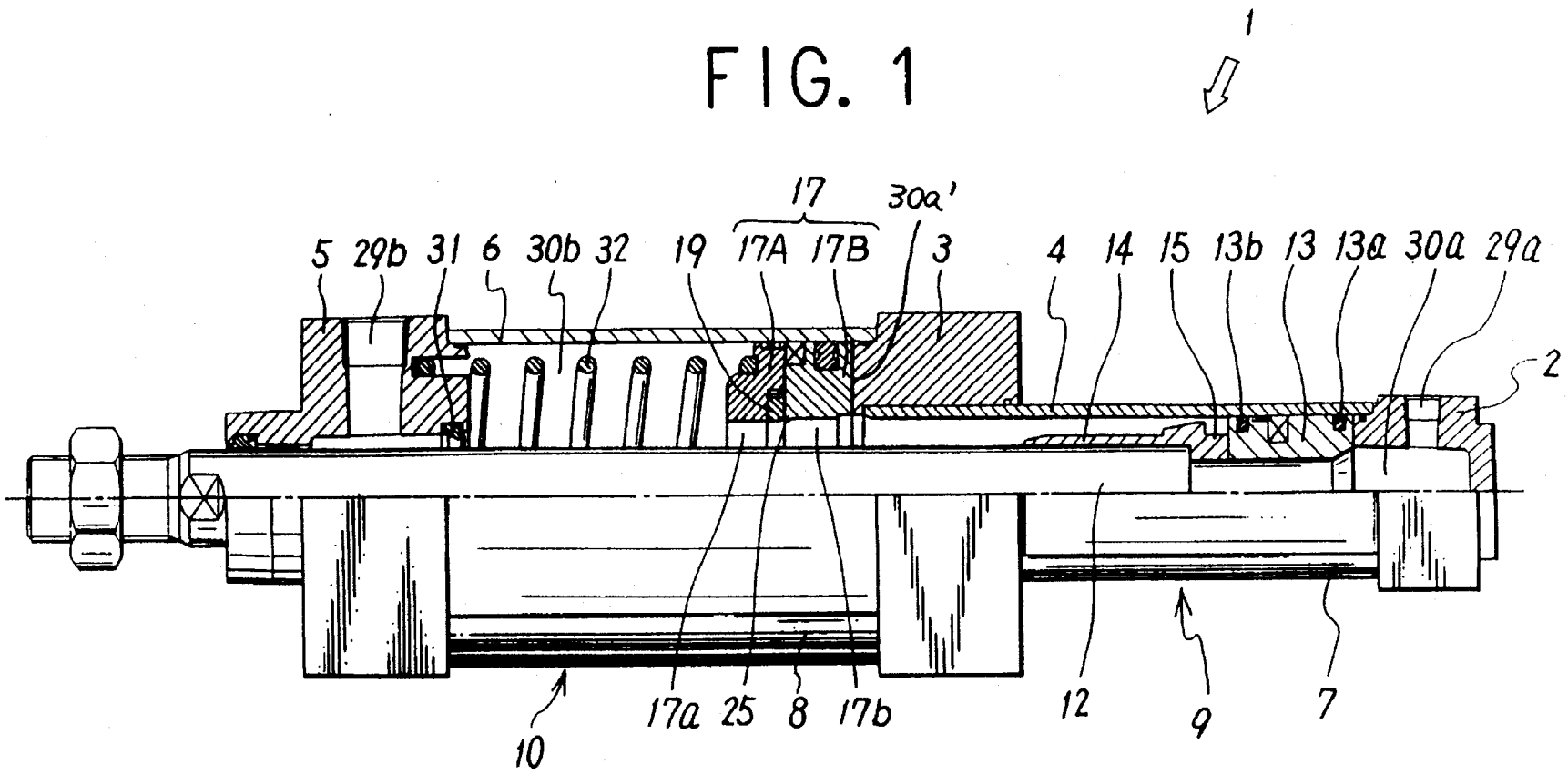
FIG. 1 is a partly sectioned front view of a first embodiment of the fluid cylinder assembly according to the invention, showing the upper half of the cylinder in section.
Figure 2:
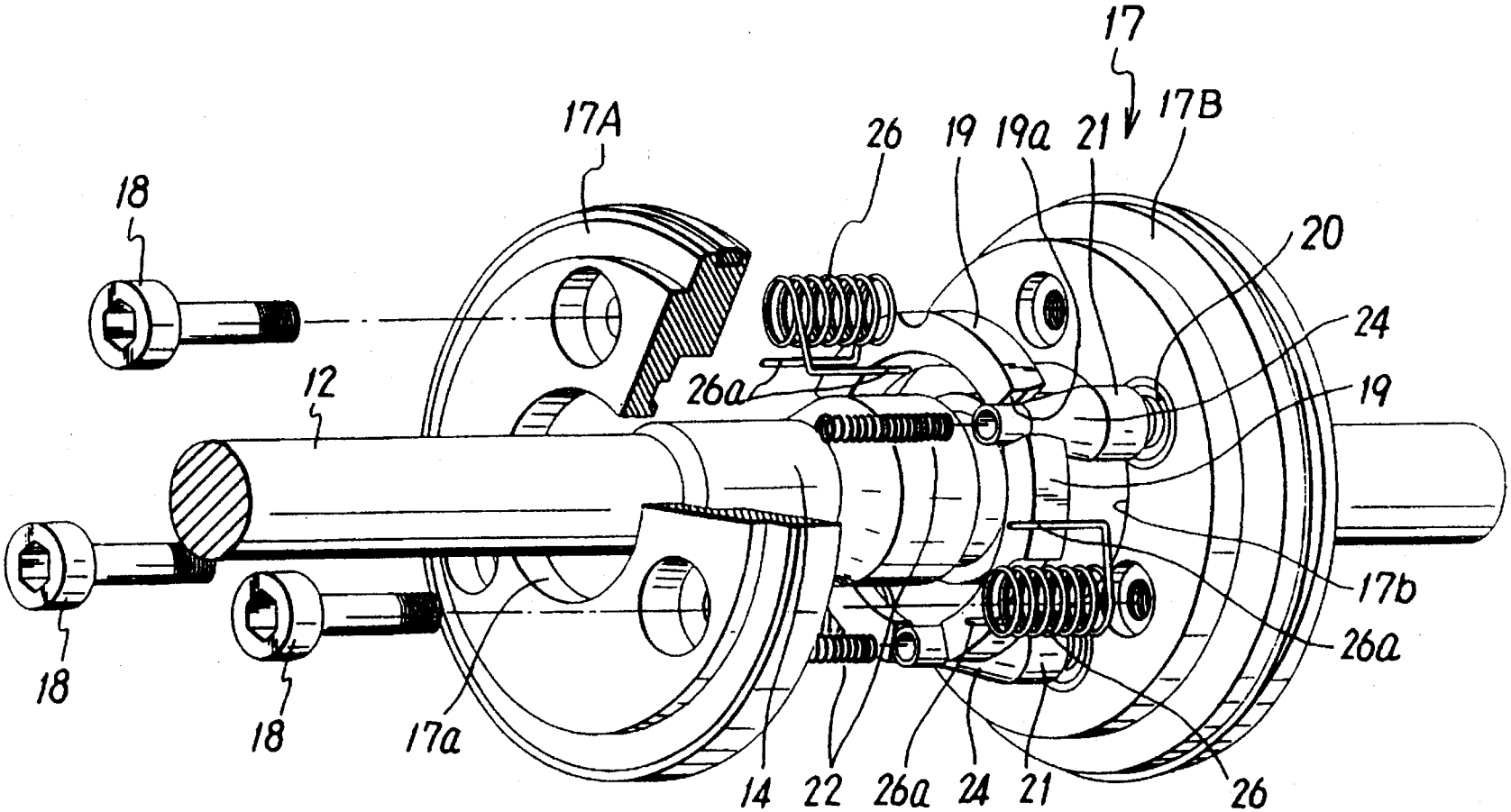
FIG. 2 is an exploded perspective view of a larger piston.

Referring to FIGS. 1 through 8, there is shown a first embodiment of the fluid cylinder assembly according to the present invention. As seen in FIG. 1, the fluid cylinder 1 is provided with a couple of smaller- and larger-diameter cylinder tubes 4 and 6 which are connected in series and in coaxial relation with each other, an annular joint member 3 which connects the two cylinder tubes in an internally intercommunicating state, a head cover 2 which is attached to the head end of the smaller-diameter cylinder tube 4, and a rod cover 5 which is attached to the distal end of the larger-diameter cylinder tube 6. The head cover 2 and the joint member 3 are fastened to each other by means of a plural number of first tie rods 7, while the joint member 3 and the rod cover 5 are fastened to each other by means of a plural number of second tie rods 8, thereby forming a first cylinder 9 of a smaller diameter and a second cylinder 10 of a larger diameter.

Extended through the first cylinder 9 and the second cylinder 10 is a common rod 12 which has a first piston 13 of a smaller diameter (hereinafter referred to simply as "smaller piston" for brevity) securely fixed by caulking on its base end portion along with a cushion ring 14 to be plunged into a cushion packing 31 in the rod cover 5. The fore end of the rod 12 is protruded out of the second cylinder 10 hermetically through the rod cover 5.

The smaller piston 13 is slidable hermetically in and along the first smaller-diameter cylinder 9 as a solitary body but it is coupled with an annular second piston 17 of a larger diameter (hereinafter referred to simply as "larger piston" for brevity) for movement in and along the second larger-diameter cylinder 10. Therefore, the smaller piston 13 is movable through the two cylinders 9 and 10 together with the rod 12 over the entire stroke range thereof.

Fitted on the circumference of the smaller piston 13 are a seal packing **13*a* to be held in hermetical sliding contact with the inner periphery of the cylinder tube 4, and a seal packing 13*b* to be brought into hermetical sliding contact with the inner periphery of the cylinder tube 4 and with a center hole 17*b* of the second larger piston 17. The aforementioned cushion ring 14 is formed with a coupling groove 15 around its circumference for engagement with locking segments 19 which are provided on the larger piston 17**.

Received in the second cylinder 10 is the above-mentioned annular larger piston 17 which is slidable hermetically in and along the second cylinder 2 alone. As shown particularly in FIG. 2, this larger piston 17 is constituted by first and second annular plate members 17A and 17B which are joined together by means of a plural number of bolts 18 (by preferably three or four bolts and by three bolts in the particular embodiment shown) at uniformly spaced positions in the circumferential direction of the piston.

As seen in FIGS. 5 to 8, alternately with the bolts 18, a corresponding number of locking segments 19 are disposed in a ring-like form around the rod 12 in a gap space between the first and second plate members 17A and 17B, for displacements in radial directions. The first plate member 17A is provided with a center hole 17*a* of a diameter slightly smaller than the smaller piston 13, while the second plate member 17B is provided with a center hole 17*b* of a diameter substantially same as the smaller piston 13. At a position closer to the first plate member 17A, the center hole 17*b* of the second plate member 17B is formed with a stopper portion 25 for abutting engagement with the first piston 13.

As seen in FIGS. 2 to 7, the second plate member 17B is formed with a plural number of pin nesting holes 20 (in the same number as the bolt 18) which are formed axially through its lateral sides at uniformly spaced positions in the circumferential direction. Axially displaceably fitted in these pin nesting holes 20 are cam pins 21 which are provided with cam sections 24 in the respective fore end portions for displacing the locking segments 19 between an inner locking position in engagement with the coupling groove 15 and an outer released position away from the coupling groove 15. The above-mentioned cam sections on the cam pins 21 are each formed in a conical shape with a gradually reduced diameter toward the first plate member 17A.

Figure 7:
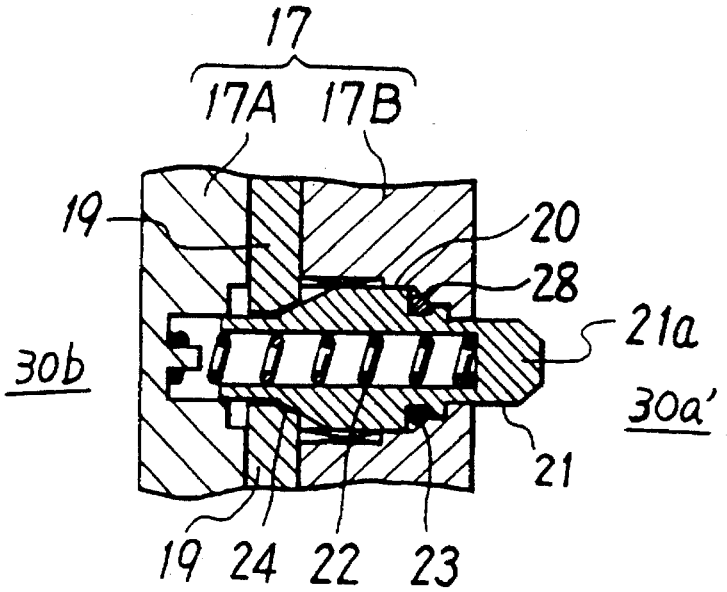
FIG. 7 is a sectional view taken on line VII—VII of FIG. 6.

The above-mentioned cam pins 21 are each urged toward the second plate member 17B by a return spring 22 which is charged between the cam pin 21 itself and the first plate member 17A. Therefore, each cam pin 21 is protruded out of the second plate member 17B toward the joint member 3 at its retractable end 21*a* as shown in FIG. 7 when the larger piston 17 is located away from the joint member 3 (as in FIG. 4), holding the cam section 24 in a receded position behind the locking segments 19 which are in engagement with the coupling groove 15. On the other hand, when the piston 17 is in abutting engagement with the joint member 3 (as in FIG. 1), the retractable end 21*a* of each cam pin 21 is pushed into the second plate member 17B, so that the cam section 24 is moved forward to lift up the locking segments 19 out of the coupling groove 15 as shown in FIG. 5.

Further, an O-ring 23 is fitted on each one of the cam pins 21 to hermetically close a seal portion 28 in the pin nesting hole 20 when the larger piston 17 is located in a position away from the joint member as described hereinbefore, thereby blocking communication between chambers 30*a* and 30*b* on the opposite sides of the larger piston 17 through the pin nesting holes 20 and the center hole 17*a* of the first plate member 17A. When the piston 17 is abutted against the joint member 3, the O-ring 23 is disengaged from the seal portion 28 to permit communication between the chambers 30*a'* and 30*b* on the opposite sides of the larger piston 17 through the pin nesting holes 20 and the center hole 17*a* of the first plate member 17A.

Fitted on each one of the plate joining bolts 18 is a pressing coil spring 26 with pressing end portions 26*a* which are extended in the axial direction of the cylinder. These pressing end portions 26*a* are abutted against the circumferential surfaces of the locking segments 19, urging the latter toward the center of the ring which is formed by the respective locking segments 19. Cam receiving surfaces 19*a* at the opposite ends of each locking segment 19 are held in abutting engagement with the cam sections 24 of adjacently located cam pins 21.

The above-described coupling groove 15, locking segments 19, cam pins 21 and pressing springs 26 constitute a coupling mechanism 27 which disengageably couples the smaller and larger pistons 13 and 17 with each other.

A first port 29*a* is opened in the head cover 2 to supply compressed air to and from a head chamber 30*a* of the cylinder, while a second port 29*b* is opened in the rod cover 5 to supply compressed air to and from a rod chamber 30*b*. A cushion packing 31 which is fitted in the inner periphery of the rod cover 5 on the side of the rod chamber 30*b* is brought into engagement with the cushion ring 14 at a position in the vicinity of the stroke end of the rod 12. A return spring 32 is loaded in the rod chamber 30*b* to urge the larger piston 17 constantly toward the joint member 3.

If desired, the coupling groove 15 may be provided on the smaller piston 13 itself, omitting the cushion ring 14.

The fluid cylinder assembly 1 of the above-described construction operates in the manner as follows. FIG. 1 shows the smaller and larger pistons 13 and 17 in initial home positions or in positions at the end of a return stroke. In this phase of operation, the larger piston 17 is in abutting engagement with the joint member 3, so that the retractable ends 21*a* of the respective cam pins 21 (FIG. 7) are pushed into the pin nesting holes 20 by the joint member 3. Namely, the cam pins 21 are moved toward the first plate member 17A, so that, as seen in FIG. 5, the cam receiving surfaces 19*a* at the opposite ends of the respective locking segments 19 are pushed radially outward by the cam sections 24 of the cam pins 21 and lifted out of the locking groove 15. As a result, the two pistons 13 and 17 are released from the interlocking action of the piston coupling mechanism.

At the same time as a result of retraction of the cam pins 21, the O-rings 23 are moved away from the seal portions 28 to intercommunicate the chambers 30*a'* and 30*b* on the opposite sides of the larger piston through the pin nesting holes 20 and the center hole 17*a* of the first plate member 17. Upon supplying compressed air to the head chamber 30*a* through the first port 29*a* while discharging air from the rod chamber 30*b* through the second port 29*b*, the smaller piston 13 and rod 12 are moved to the left in FIG. 1. However, since the coupling mechanism 27 is still in a released state as described hereinbefore, the two pistons 13 and 17 remain unlocked to each other up to a mid point of the driving stroke, and the larger piston 17, which is free from the action of the fluid pressure in the head chamber 30*a*, stays in the home position or return end position under the influence of the biasing force of the return spring 32.

Figure 3:
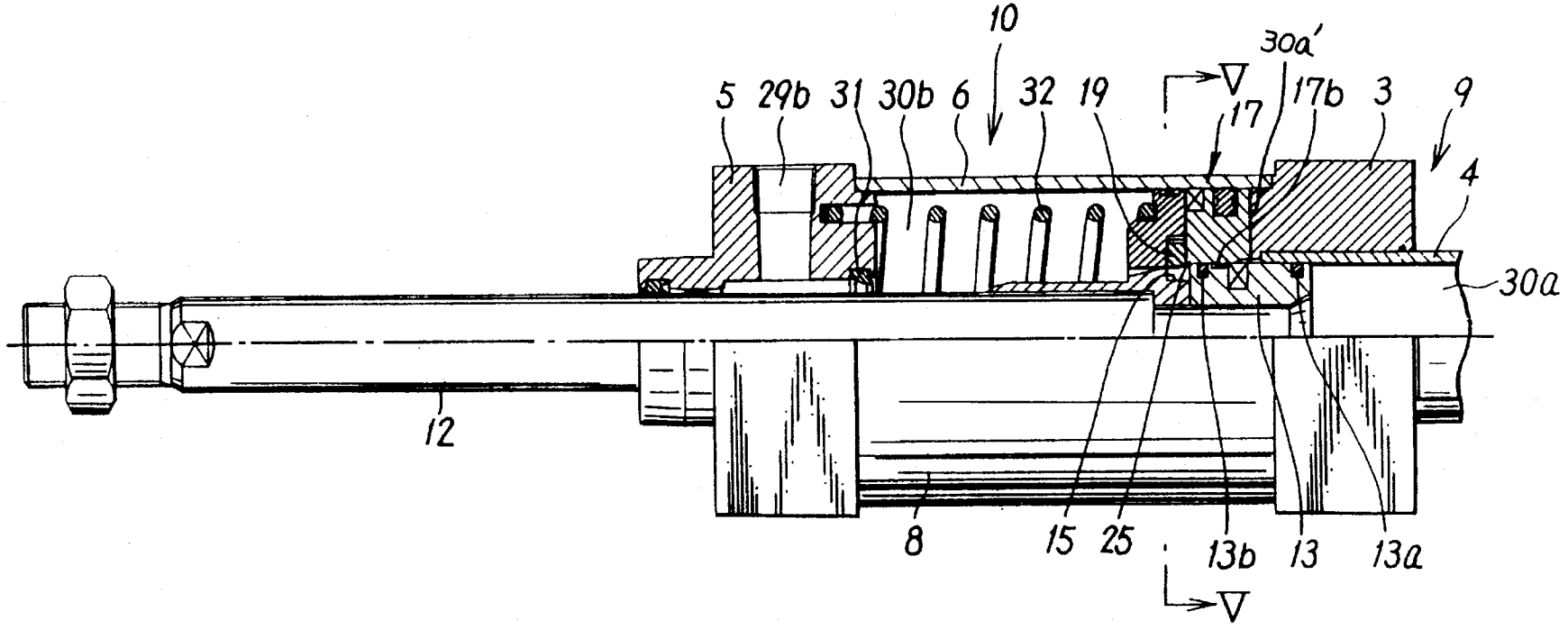
FIG. 3 is a partly sectioned front view of the fluid cylinder of FIG. 1 at a halfway point of its driving stroke.

As soon as the smaller piston 13 enters the center hole 17B of the larger piston 17 by a further leftward movement of the rod 12 as shown in FIG. 3, the seal packing 13*b* forms a hermetical seal between the smaller and larger pistons 13 and 17. Succeedingly, the smaller piston 13 comes into abutment against the stopper ridge 25 to push the larger piston 17 in the leftward direction. Consequently, the two pistons 13 and 17 start to move together in that direction.

Figure 6:
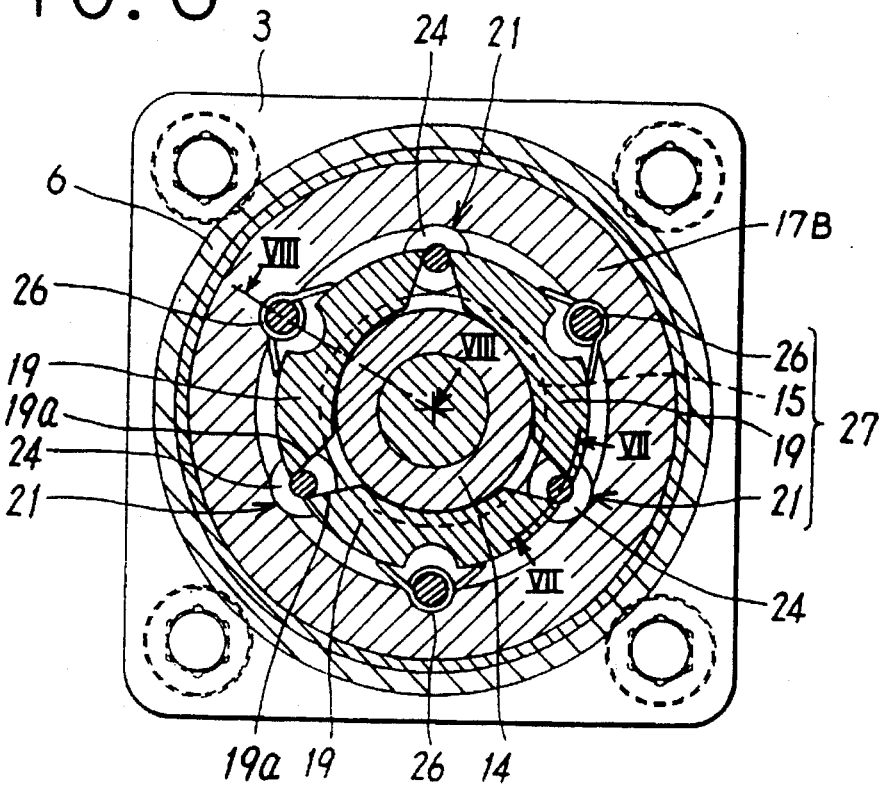
FIG. 6 is a sectional view taken on line VI—VI of FIG. 3.
Figure 8:
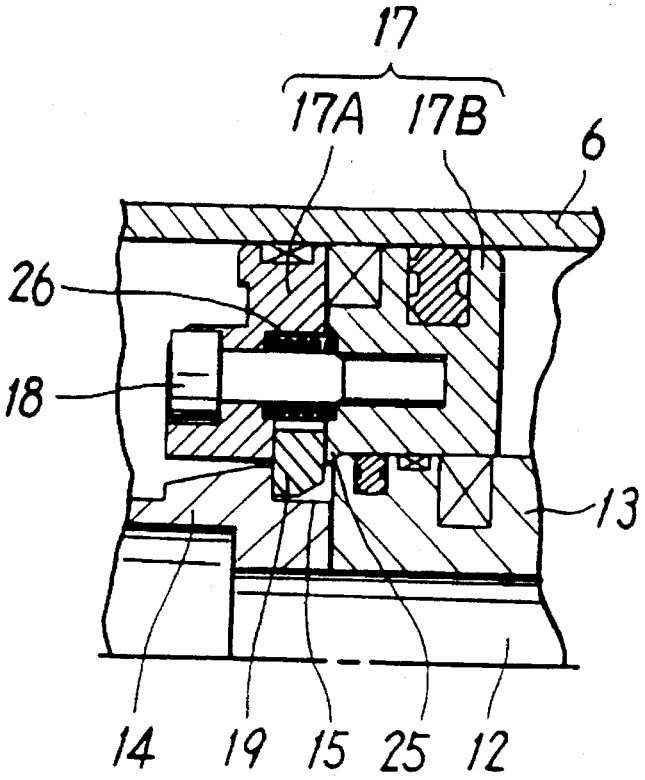
FIG. 8 is a sectional view taken on line VIII—VIII of FIG. 6.

As soon as the larger piston 17 starts to move in the leftward direction away from the joint member 3, the respective cam pins 21 are moved toward the joint member 3 by the biasing forces of the return springs 20 to protrude their retractable ends 21*a* out of the second plate member 17B as shown in FIGS. 6 to 8. Simultaneously, the cam sections 24 of the respective cam pins 21 are receded from the locking segments 19, relieving the latter of their lifting actions. Consequently, the locking segments 19 are displaced toward the center of the cylinder and into the coupling groove 15 on the cushion ring 14 under the influence of the biasing actions of the presser springs 26, thereby coupling the smaller piston 13 with the larger piston 17. Now, the smaller piston 13, larger piston 17 and rod 12 move to the left as one integral body within the second cylinder 12.

Thus, the overall pressure receiving area of the piston is broadened as a result of the unification of the smaller and larger pistons 13 and 17, and the pneumatic pressure prevailing in the head chamber 30*a* acts on both of the smaller and larger pistons 13 and 17 to boost the driving force in the latter half of the forward stroke of the rod 12.

In an initial stage of the piston coupling when the smaller piston 13 plunges into the larger piston 17, there may arise a situation where the first cylinder 9 is sealed by the seal packing 13*a* and the center hole 17*b* of the larger piston 17 is sealed by the other seal packing 13*b*. In such a case, the chambers 30*a'* and 30*b* on the opposite sides of the larger piston are in communication with each other, so that there is no possibility of air being sealed in the space between the seal packings 13*a* ad 13*b*. Accordingly, the smaller piston 13 can move smoothly into the coupled position of FIG. 3 where it is completely fitted in the larger piston 17, and thereafter the two pistons 13 and 17 move smoothly as a unitary body.

As soon as the two coupled pistons 13 and 17 move to a position where the smaller piston 13 starts to leave the first cylinder 9, the respective cam pins 21 are returned to the protruded positions, closing the seal portions 28 with the O-rings 23 to block the communication between the chambers 30*a'* and 30*b*. Therefore, there is no possibility of leakage of compressed air into the rod chamber 30*b* from the chamber 30*a'* which forms part of the head chamber 30*a*.

Figure 4:
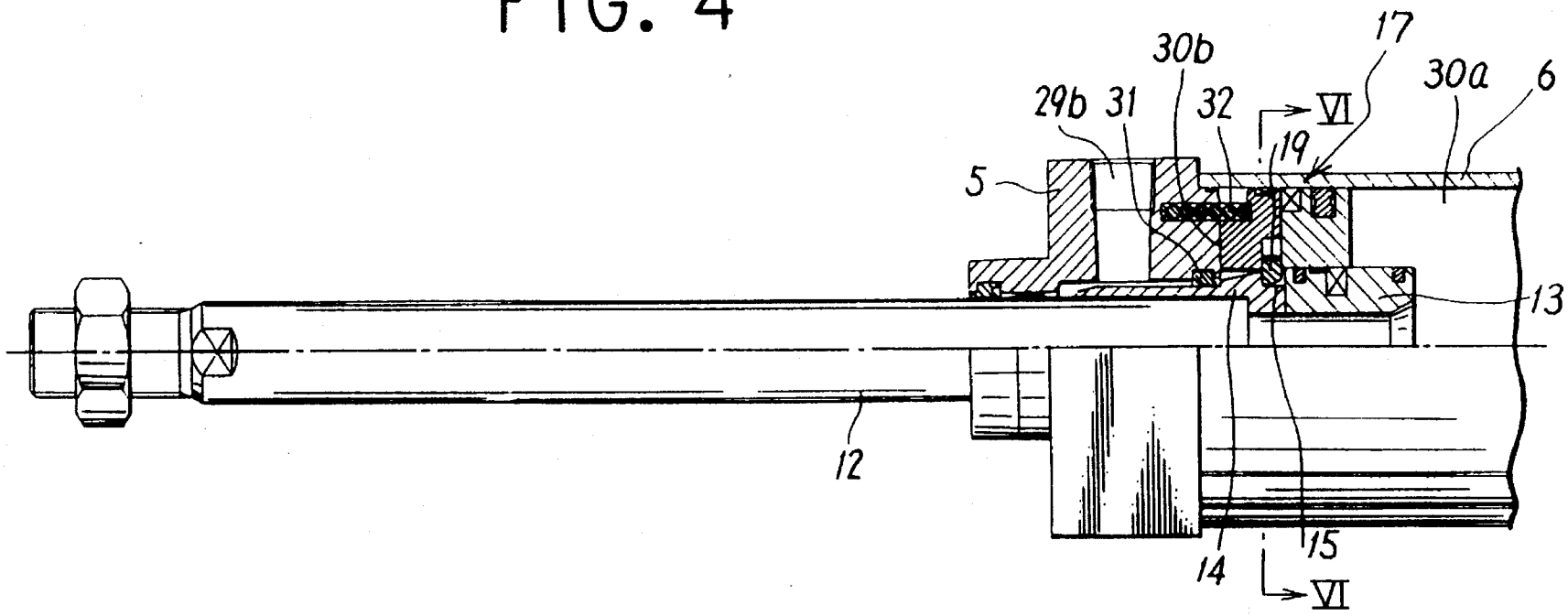
FIG. 4 is a partly sectioned front view of the fluid cylinder of FIG. 1 at the end of its driving stroke.
Figure 5:
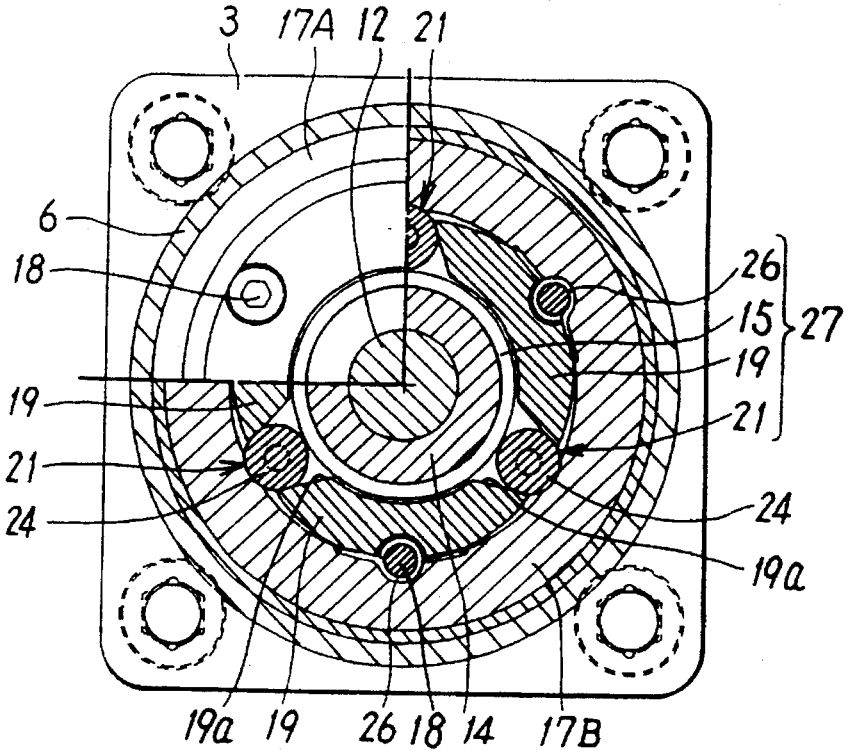
FIG. 5 is a sectional view taken on line V—V of FIG. 3.

As shown in FIG. 4, as the cushion ring 14 plunges into the cushion packing 31 at a point close to the end of the driving stroke, discharge air is temporarily closed in the rod chamber 30*b*, increasing the air pressure to brake and stop the movement of the pistons 13 and 17 in a suitably cushioned state at the end of the forward driving stroke.

Then, compressed air is supplied to the rod chamber 30*b* through the second port 29*b* while discharging air out of the head chamber 30*a* through the first port 29*a*. Whereupon, the large and small pistons 17 and 13 are moved together in the return direction (to the right in FIG. 1) by the biasing force of the return spring 32 and the air pressure in the rod chamber 30*b*.

As soon as the larger piston 17 comes into abutment against the joint member 3 at the end of its return stroke, the respective cam pins 21 are pushed by the joint member 3 into retracted positions within the pin nesting holes 20 and as a result the respective locking segments are lifted in radially outward directions by the cam sections 24 on the cam pins 21 to release the piston coupling mechanism 27, namely, to uncouple the smaller piston 13 from the larger piston 17. Accordingly, the larger piston 17 is stopped at its home position at the right end of the second cylinder 10, but the smaller piston 13 is continuedly moved together with the rod 12 as far as the return stroke end by the compressed air pressure in the rod chamber 30*b*. At the same time, the O-rings 23 open the seal portions 28 to intercommunicate the chambers 30*a'* and 30*b* for smooth separation of the smaller piston 13 from the larger piston 17.

Thus, according to the above-described embodiment, the smaller piston 13 is coupled with the larger piston 17 in a latter half of each forward driving stroke to form a unified piston body with a broadened pressure receiving area for boosting the driving force in the latter half of the driving stroke.

The above-described fluid cylinder assembly 1 is arranged to move the smaller piston 13 through both of the small- and large-diameter cylinders 9 and 10 via the annular joint member 3, so hat its axial length for a given stroke length of the rod can be reduced drastically as compared with the conventional tandem type fluid cylinders in which the pistons are reciprocated separately in the respective cylinders.

Figure 9:
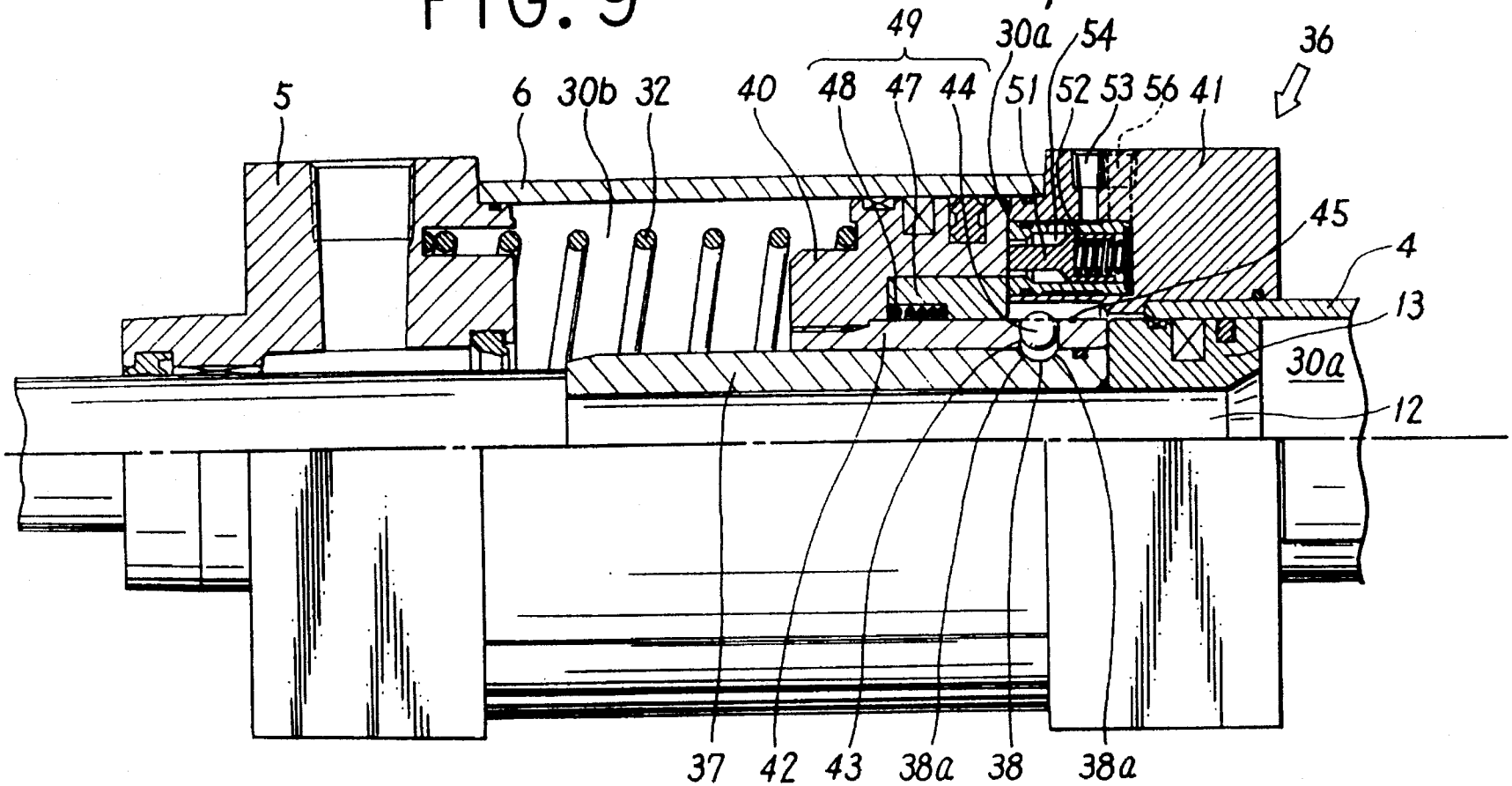
FIG. 9 is a partly sectioned front view of a second embodiment of the fluid cylinder assembly according to the invention, at a halfway point of its driving stroke.
Figure 10:
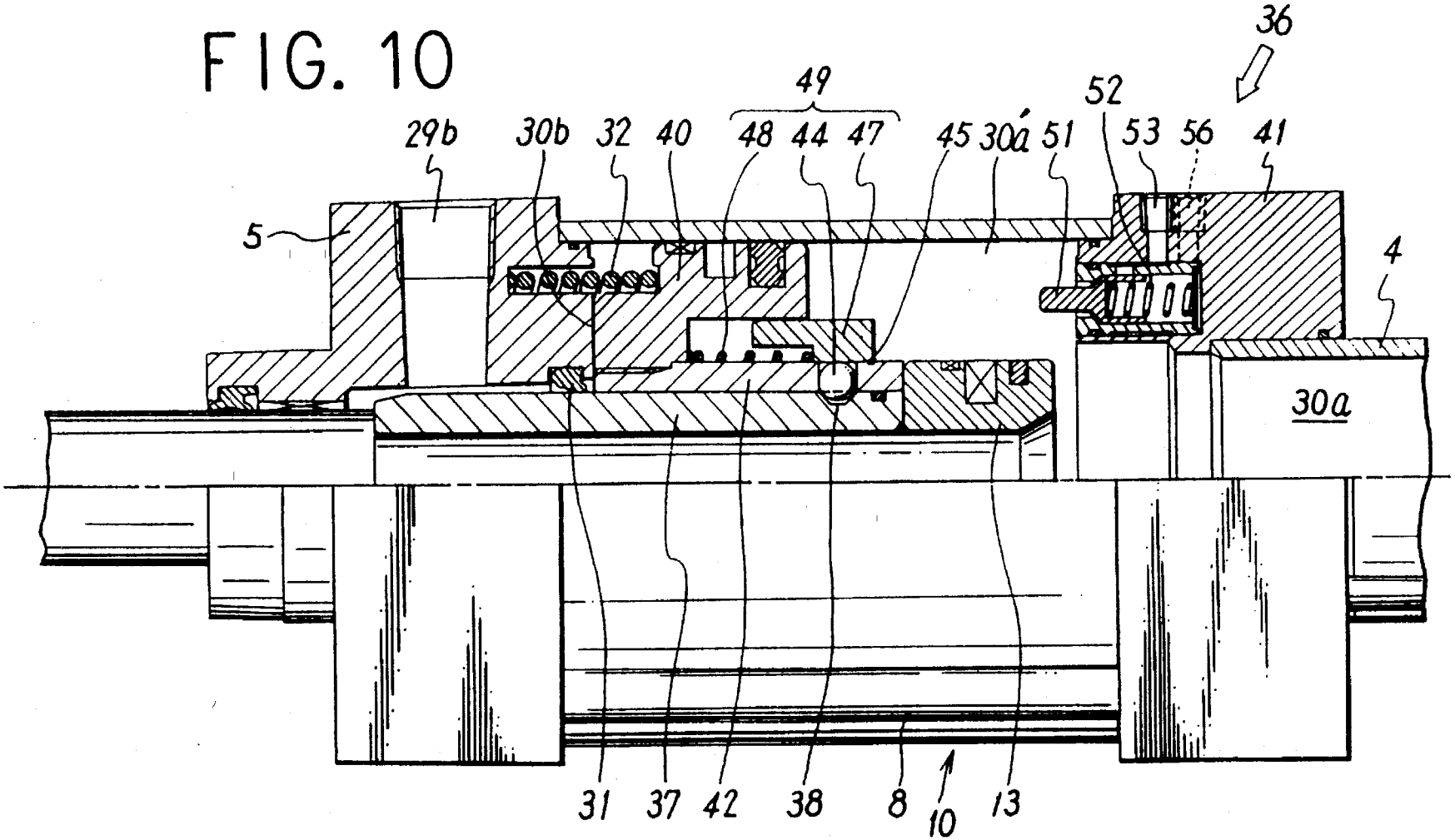
FIG. 10 is a partly sectioned front view of the fluid cylinder of FIG. 9 at the end of its driving stroke.

Referring now to FIGS. 9 and 10, there is shown a second embodiment of the present invention, namely, a fluid cylinder assembly 36 which employs a different locking means for a pair of pistons 13 and 40 in place of the locking segments in the above-described first embodiment.

More particularly, the fluid cylinder assembly 36 is provided with an annular coupling groove 38 on the outer periphery of a cushion ring 37, the coupling groove 38 having side walls 38*a* inclined inwardly toward each other to have a gradually reduced width toward its bottom.

Threaded into the annular larger piston 40 is a sleeve-like ball holder 42 which is extended toward an annular joint member 41. The ball holder 42 is formed with three or four ball trap holes 43 (three ball trap holes in the particular embodiment shown) at uniformly spaced positions around its circumference, the ball trap holes 43 receiving therein balls 44 radially displaceably to serve as locking means. A stopper ring 45 is fixedly fitted on the circumference of the ball holder 45 at a position closer to the joint member 41 than the ball trap holes 43.

In order to press the balls 44 into the locking groove 38, a sleeve-like ball presser member 47 is axially displaceably fitted on the ball holder 42. The ball presser sleeve 47 is constantly urged to slide toward the joint member 41 by means of a compression spring 48 which is charged between stepped wall portions on the inner peripheries of the ball presser sleeve 47 and the larger piston 40. On the other hand, the range of sliding displacement of the ball presser sleeve 47 toward the joint member 41 is delimited by abutment against the stopper ring 45 which also serves to prevent dislocation of the ball presser member 47 off the ball holder 42.

Thus, in this embodiment, the above-described coupling groove 38, balls 44, ball presser member 47 and compression spring 48 constitute a piston coupling mechanism 49.

The joint member 41 is internally provided with an air passage 53 to communicate a chamber 30*a'*, which is formed in the second cylinder 10 on the side of its head end, with the atmosphere, a valve chamber formed between the chamber 30*a'* and the air passage 53, a valve member disposed in the valve chamber 54 to open and close communication between the chamber 30*a'* and the air passage 53, and a valve spring 52 constantly urging the valve member 51 toward the larger second piston 40. In the drawings, the reference 56 denotes a breathing hole which communicates the spring chamber behind the valve member 51 with the atmosphere.

In other respects, the second embodiment is substantially same as the foregoing first embodiment in construction, so that common major component parts are simply denoted by common reference numerals without repeating detailed descriptions on them.

With the fluid cylinder assembly of the above-described second embodiment, when the larger piston 40 is in the home position or in its return end position as shown in FIG. 9, it is abutted against the joint member 41 by the biasing force of the return spring 32. Therefore the ball presser member 47 is pushed into a retracted position by the joint member 41 against the biasing force of the pressing spring 48, leaving the balls 44 in released state. Accordingly, the smaller and larger pistons 13 and 40 are not yet coupled with each other.

Besides, the valve member 51 is pushed into a retracted position by the larger piston 40 to open the air passage 53, so that the chamber 30*a'* in the second cylinder 10 is in communication with the atmosphere through the air passage 53.

In this state, the smaller piston 13 is moved to the left and, hermetically abutted on the larger piston 40 as shown in FIG. 9, causing the larger piston to start a leftward movement away from the joint member 41. Whereupon, as shown in FIG. 10, the ball presser member 47 is advanced under the influence of the biasing force of the spring 48 to push in the respective balls 44 toward the center of the rod 12 and into engagement with the coupling groove 38 to couple the smaller piston 13 with the larger piston 40. As a result, the coupled pistons 13 and 40 are put in movement toward the end of the second cylinder 10 together with the rod 12.

At this coupling stage, since the chamber 30*a'* in the second cylinder 10 is opened to the atmosphere through the passage 53 as described hereinbefore, the larger piston 40 and the smaller piston 13 are moved smoothly from the position shown in FIG. 9.

On a further leftward movement of the two coupled pistons 13 and 40 toward the end of the forward driving stroke, the larger piston 40 is moved away from the joint member 41 and the smaller piston 13 is introduced into the second cylinder 10 from the first cylinder 9, while the valve member 51 is pushed out into the protruded position by the biasing force of the valve spring 52, closing the air passage 53 to shield the chamber 30*a'* from the atmosphere. Therefore, there is no possibility of leakage of compressed air from the chamber 30*a'*.

Upon supplying compressed air to the rod chamber 30*b* while discharging air from the head chamber 30*a*, the two coupled pistons 13 and 40 are moved in the reverse direction to start a return stroke integrally with the rod 12.

As soon as the larger piston 40 comes into abutment against the joint member 41 at its return end, the ball presser member 47 is pushed into a retracted position by the joint member 41, relieving the balls 44 of its pressing action. As the smaller piston 13 continues its return movement together with the rod 12, the balls 44 are raised along inclined side walls 38*a* to get out of the locking groove 38, uncoupling and separating the two pistons 13 and 40 from each other. Accordingly, the larger piston 40 is stopped at its return end by abutment against the joint member 41, while the smaller piston 13 is moved through to the return stroke end together with the rod 12.

Further, immediately before the larger piston 40 comes into abutment against the joint member 41, it presses the valve member 51 to open the passage 53 which communicates the chamber 30*a'* on the head side of the second cylinder 10 with the atmosphere. This prevents air from being sealed in between the two pistons 13 and 40 even if the smaller piston 13 happens to fit fluid-tight in the cylinder tube 4 of smaller diameter before the larger piston 40 reaches the above-described home position at the head end of the second cylinder 10. Consequently, the larger piston 40 is allowed to return its home position smoothly in a secure manner, while the smaller piston 13 is moved continuedly toward the stroke end also in a secure manner.

Thus, the fluid cylinder assembly according to the present invention employs a pair of smaller and larger pistons which are arranged to be coupled into a unitary piston body with an increased pressure receiving area at a mid point of the forward driving stroke of a common piston rod, thereby boosting the driving force of the cylinder in the latter half of each driving stroke of the rod.

In addition, in the fluid cylinder assembly according to the present invention, the smaller piston which is movable through a pair of smaller- and larger-diameter cylinders locked in the larger piston during movement within the larger cylinder, so that, as described hereinbefore, the axial length of the fluid cylinder assembly for a given stroke length of the rod can be reduced to a marked degree, as compared with the conventional tandem type fluid cylinders in which pistons are reciprocated separately in the respective cylinders only. Accordingly, the present invention contributes to provide a fluid cylinder of very compact form.

What is claimed is:

1. A fluid cylinder assembly, comprising:

a first cylinder of a smaller diameter and a second cylinder of a larger diameter, connected with each other in a coaxially intercommunicating state through a joint member;

a piston rod commonly passed through said first and second cylinders;

a larger piston fitted in said second cylinder for sliding movements only in and along said second cylinder;

a smaller piston mounted at one end of said piston rod for movements in and along said first and second cylinders over the entire stroke range of said piston rod, said smaller piston being adapted to move as a solitary body within said first cylinder in fluid-tight sliding contact therewith and to be coupled with said larger piston during movement within said second cylinder;

a biasing means for urging said larger piston toward a return end position at the head end of said second cylinder;

a coupling mechanism for coupling said smaller piston with said larger piston in a locked state during movement within said second cylinder; and a valve means adapted to open a chamber on the head side of said second cylinder to the atmosphere when said larger piston is located at said return end position and to shield said chamber from the atmosphere when the larger piston is moved away from the return position.

2. A fluid cylinder assembly as defined in claim 1, wherein said coupling mechanism comprises:

a coupling groove formed around the circumference of said smaller piston;

a plural number of locking segments provided on the part of said larger piston and arranged in a ring-like form around said piston rod, said locking segments being radially displaceable into and out of engagement with said coupling groove;

a spring means constantly urging the respective locking segments toward said coupling groove;

a cam means for displacing the respective locking segments radially into and out of engagement with said coupling groove, said cam means moving said locking segments into a released position away from said coupling groove when said larger piston is located at said return end position within said second cylinder and into a locking position in engagement with said coupling groove when said smaller piston comes into abutment against said larger piston in the course of a forward driving stroke of said piston rod.

3. A fluid cylinder assembly as defined in claim 2, wherein said cam means is constituted by a number of cam pins partly retractably projected out of pin nesting holes on said larger piston, said cam pins being pushed into retracted positions in said pin nesting holes by said joint member when said larger piston is abutted against said joint member at said return end position in said second cylinder, thereby forcing the respective locking segments to displace into the released position away from the coupling groove, and said cam pins being projected out of said pin nesting holes as soon as said larger piston is moved away from said joint member, thereby permitting the respective locking segments to move into coupling positions in engagement with said coupling groove.

4. A fluid cylinder assembly as defined in claim 3, wherein said cam pins are arranged to serve also as said valve means and provided with O-rings to be disengageably brought into engagement with seal portions in said pin nesting holes, said cam pins being pushed into retracted positions by abutment against said joint member at the return end of said larger piston, disengaging said O-rings from said seal portions to open said chamber to the atmosphere, and said cam pins being projected from said pin nesting holes as soon as said larger piston is moved away from said joint member, abutting the respective O-rings against said seal portions to shield said chamber from the atmosphere.

5. A fluid cylinder assembly as defined in claim 1, wherein said piston coupling mechanism comprises:

a coupling groove formed around the circumference of said smaller piston;

a plural number of balls retained in a ball holder on said larger piston and adapted to be brought into and out of engagement with said coupling groove;

a sleeve-like ball presser slidably fitted on the outer periphery of said ball holder and axially displaceable between a locking position for holding the balls in said coupling groove and a releasing position for releasing said balls from said coupling groove, said ball presser being arranged to be displaced toward said releasing position when said larger piston is abutted against said joint member at the return end position and to be displaced toward said locking position when said larger piston is moved away from said joint member; and a spring means for urging the ball presser constantly toward the locking position.

6. A fluid cylinder assembly as defined in claim 5, wherein said valve means is built into said joint member, and comprises a valve chamber communicating said chamber on the head side of said second cylinder with the atmosphere through an air passage, and a valve member disposed in said valve chamber for opening and closing said air passage and constantly urged by a spring to protrude partly into said chamber in said second cylinder, said valve member being adapted to open said air passage when pushed into a retracted position in said valve chamber by said larger piston and to close said air passage when released into a protruded position.

* * * * *